US006269955B1

(12) United States Patent
Morimoto et al.

(10) Patent No.: US 6,269,955 B1
(45) Date of Patent: Aug. 7, 2001

(54) AIR CURRENT CLASSIFYING SEPARATOR

(75) Inventors: Hiroshi Morimoto; Nozomu Oda; Hiromu Terada, all of Mie (JP)

(73) Assignee: Nippon Pneumatic Manufacturing Co., Ltd., Osaka (JP)

( * ) Notice: Subject to any disclaimer, the term of this patent is extended or adjusted under 35 U.S.C. 154(b) by 0 days.

(21) Appl. No.: 09/301,334

(22) Filed: Apr. 29, 1999

(30) Foreign Application Priority Data

Mar. 3, 1999 (JP) ..... 11-055748

(51) Int. Cl.[7] ..... B04C 3/00

(52) U.S. Cl. ..... 209/723; 209/139.1; 209/142; 209/143; 209/722

(58) Field of Search ..... 209/138, 139.1, 209/139.2, 149, 722, 723, 143, 142

(56) References Cited

U.S. PATENT DOCUMENTS

| | | | | |
|---|---|---|---|---|
| 1,367,636 | * | 2/1921 | Sturtevant | 209/135 |
| 1,761,627 | * | 6/1930 | Hine | 209/135 |
| 2,055,485 | * | 9/1936 | Fraser | 209/135 |
| 2,329,299 | * | 9/1943 | Rourke | 209/135 |
| 3,306,443 | * | 2/1967 | Sereno et al. | 209/135 |
| 3,643,800 | * | 2/1972 | Mansson | 209/723 |
| 3,753,336 | * | 8/1973 | Drew et al. | 209/723 |
| 4,149,861 | * | 4/1979 | Sogo et al. | 55/261 |
| 4,221,655 | * | 9/1980 | Nakayama et al. | 209/135 |
| 5,016,823 | * | 5/1991 | Kato et al. | 241/5 |
| 5,032,222 | * | 7/1991 | Millioud | 159/4.1 |
| 5,165,549 | * | 11/1992 | Kanda et al. | 209/135 |

* cited by examiner

*Primary Examiner*—Donald P. Walsh
*Assistant Examiner*—Daniel K Schlak
(74) *Attorney, Agent, or Firm*—Wenderoth, Lind & Ponack, L.L.P.

(57) ABSTRACT

The object of the classifier of the present invention is to reduce the classification point for classifying powder. The classifier includes a classifying cover having a conical bottom surface, a classifying plate provided under the classifying cover and having a conical top surface opposite the conical bottom surface of the classifying cover, and a plurality of louvers provided annularly around a classifying chamber defined between the conical bottom surface and the conical top surface to define passages for secondary air therebewen. The conical bottom surface is inclined at a larger angle than the conical top surface.

10 Claims, 7 Drawing Sheets

AIR CURRENT CLASSIFYING SEPARATOR

BACKGROUND OF THE INVENTION

This invention relates to a classifier for centrifugally separating powder such as toner powder used in a copier, or inorganic compounds such as metal oxides, glass and ceramics into fine and coarse particles.

FIG. 6 shows a conventional classifier. It includes a plurality of pivotable louvers 33 provided around a classifying chamber 32 defined between a classifying cover 30 and a classifying plate 31. Defined between the adjacent louvers 33 are passages through which secondary air is introduced into the classifying chamber 32 in a whirling flow. A powder supply tube 34 is provided over the classifying cover 30 to define a powder supply port 35 between the bottom inner edge of the tube 34 and the outer edge of the classifying cover 30.

A fine powder discharge tube 36 is connected to the center of the classifying plate 31, while a coarse powder discharge port 37 is provided around the classifying plate 31.

In operation, while a suction force from a blower is applied to the fine powder discharge tube 36, a fluid mixture of powder and compressed air is supplied into the top of the powder supply tube 34 so that the mixture will be supplied into the classifying chamber 32 through the powder supply port 35 in a whirling flow. At the same time, secondary air is blown into the classifying chamber 32 through the passages between the louvers 33 to increase the whirling speed of the mixture, thereby centrifugally classifying the powder so that finer particles will move toward the center of the chamber 32 to be discharge through the fine powder discharge tube 36, while coarser particles will whirl along the outer periphery of the chamber 32 to be discharge through the coarse powder discharge port 37.

In the powder classification in which a classifier of the above-described type is used, especially in the manufacture of fine powder such as ceramic powder used as material for electronic parts, the lower the classification point and the nearer the maximum particle diameter is to the classification point, the more uniform the particle diameter of the fine powder obtained.

The term "classification point" herein used refers to the particle diameter at the intersection of the particle diameter distribution curves for collected fine and coarse powder particles.

In this type of conventional classifier, micron-order classification is already possible. But there is a demand to further reduce the powder classification point in fields where the product is fine powder. Also it is required to reduce the maximum particle size of fine powder.

It is known that the classification point of powder is affected by the whirling speed of fluid in the classifying chamber 32, and the classification point can be decreased by increasing the whirling speed of fluid.

The whirling speed of fluid in the classifying chamber 32 can be increased by increasing the supply pressure of the fluid mixture introduced into the classifying chamber 32 in a whirling flow. But the supply pressure cannot be increased without a limit.

Thus, in this type of classifier, the angles of the louvers 33 are adjusted with the supply pressure of fluid mixture kept constant to change the flow rate of secondary air introduced into the classifying chamber 32, thereby adjusting the whirling speed of fluid in the chamber.

Based on the knowledge that there is a correlation between the whirling speed of powder in the classifying chamber and the classification point, the inventors thought that the whirling speed may have some influence on the maximum particle diameter, and measured the tangential flow speed at various positions in the classifying chamber 32. The results are shown in FIG. 7. For the test, the classifier shown in FIG. 6 was used.

The dimensions of the classifier used for measurement are shown in Table 1.

TABLE 1

| Symbol | $D_3$ | $D_4$ | $D_5$ | $d_2$ | $H_2$ | α, β |
|---|---|---|---|---|---|---|
| Size(mm) | 280 | 195 | 270 | 60 | 20 | 24° |

In the table,

D3=inner diameter of the classifying chamber 32

D4=outer diameter of the classifying cover 30

D5=outer diameter of the classifying plate 31 d2=inner diameter of the fine powder discharge tube 36

H2=height of the louvers 33

α2, β2=inclination angles of the conical bottom surface of the classifying cover 30 and the conical top surface of the classifying plate 31

Measurement was made with high-pressure (2 kg/cm$^2$) air being blown into the powder supply tube 34 and a suction force of −0.3 kg/cm$^2$ applied to the fine powder discharge tube 36.

The velocity curves (I) to (IV) in FIG. 7 represent whirling speeds when the gap between louvers 33 was set at 1 mm, 3 mm, 5 mm and 7 mm, respectively.

As will be apparent from FIG. 7, in this type of classifier, the fluid whirling speed is extremely high at a point slightly spaced from the center of the classifying chamber 32 (that is, a point slightly offset inwardly from the inner surface of the fine powder discharge tube 36), and decreases gradually toward the inner surface of the classifying chamber 32.

In the conventional classifier, because the powder supply port 35 formed along the outer edge of the classifying cover 30 is an area where the whirling speed is relatively low, the whirling speed of powder supplied into the classifying chamber 32 through the powder supply port 35 is low. It is thus impossible to impart a sufficient dispersing and whirling force to the powder.

Coarse particles are thus likely to mix into fine particles, increasing the maximum particle diameter of fine powders.

Also, in the conventional classifier, the classifying chamber 32 for classifying powder into fine and coarse particles by centrifugal force has a cylindrical inner surface 38 above the louvers 33. Therfore, so that powder whirling in the outer circumference of the classifying chamber 32 tends to dwell, adhere to the cylindrical inner surface 38, and build up without being sufficiently acted on by secondary air introduced into the classifying chamber 32 through the gaps between the louvers 33. This tendency is especially remarkable if the powder particle diameter is small because such small-diameter powder particles tend to be more strongly pushed against the cylindrical inner surface 38 by centrifugal force. This reduces the recovery rate of classified powder. Also, due to the adhesion of powder, the shape of the classifying chamber tends to change, making it impossible to operate the classifier stably with a constant classification point.

An object of the present invention is to reduce the classification point of powder in a classifier of the above-described type.

Another object of this invention is to achieve a stable operation with a constant classification point, and to increase the recovery rate of classified powder.

A further object of this invention is to reduce the maximum particle diameter of powder as a product.

SUMMARY OF THE INVENTION

According to this invention, there is provided a classifier comprising a casing, a cover provided over the casing and having a conical bottom surface, a classifying plate provided under the cover and having a conical top surface which defines a classifying chamber between the conical bottom surface of the cover and the conical top surface of the classifying plate and a plurality of louvers arranged around the classifying chamber, passages defined between the louvers, a fine powder discharge tube connected to the central portion of the classifying chamber, a coarse powder discharge port defined around the outer edge of the classifying plate, where by powder supplied into and whirling in the classifying chamber is accelerated by secondary air introduced into the classifying chamber through the passages, whereby discharging fine powder through the fine powder discharge tube and discharging coarse powder through the coarse powder discharge port, characterized in that the conical bottom surface of the classifying cover has a larger inclination angle than the conical top surface of the classifying plate.

To solve the second object, the conical bottom surface of the cover has a circular outer edge having a diameter substantially equal to the inner diameter of the casing, and provided at substantially the same level as the top edges of the louvers.

To solve the third object, a powder supply device is provided over the classifying cover for supplying a fluid mixture of powder and compressed air in a whirling flow into the central portion of the classifying chamber.

The fluid mixture should be supplied to a high-speed whirling area where the mixture whirls at a high speed, the area being an area over the inlet of the fine powder discharge tube.

The powder supply device may comprise a powder supply tube having its bottom end connected to the center of the top of the classifying cover, a compressed air injection nozzle connected to the top of the powder supply tube, and a hopper having its bottom outlet communicating with a tip of the injection nozzle. The powder supply tube has an air injection hole for blowing compressed air toward an outer peripheral area in the powder supply tube.

Other features and objects of the present invention will become apparent from the following description made with reference to the accompanying drawings, in which:

DETAILED DESCRIPTION OF THE PREFERRED EMBODIMENT

Embodiments of this invention are described with reference to the drawings.

Figure 1:
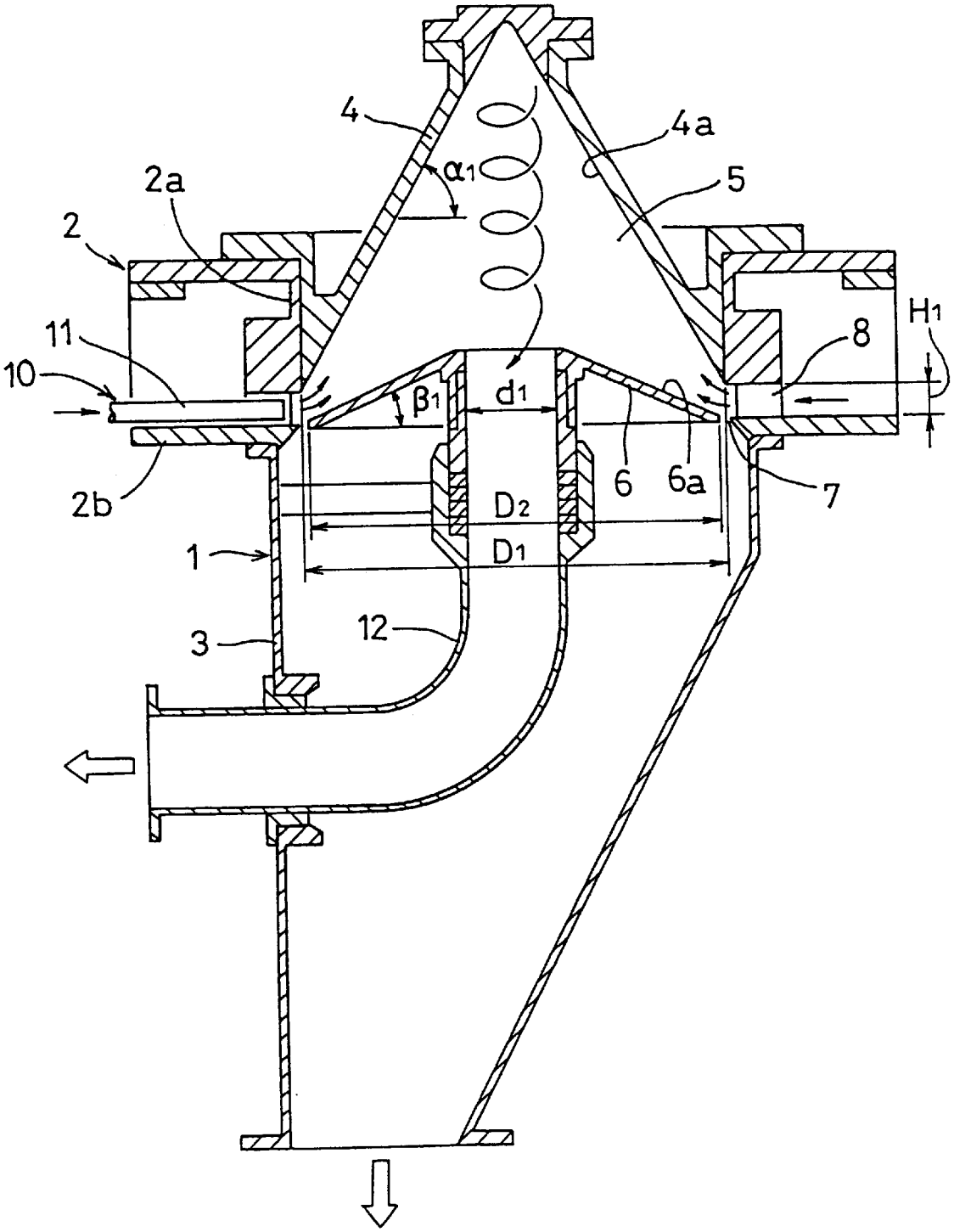
FIG. 1 is a vertical sectional front view of a classifier of a first embodiment of this invention.

In FIG. 1, a casing 1 comprises an upper cylindrical casing 2 and a downwardly tapering conical lower casing 3. The upper casing 2 has a top opening closed by a conical classifying cover 4.

The cover 4 is detachably mounted to the upper casing 2 by for example, bolts. A classifying plate 6 is provided under the cover 4 to define a classifying chamber 5 between cover. An annular coarse particle discharge port 7 is defined between the outer edge of the classifying plate 6 and the inner periphery of the upper casing 2.

The conical cover 4 has a conical inner (bottom) surface 4*a* having an inclination angle $\alpha 1$ with respect to a horizontal plate of the classifying chamber, while the conical classifying plate 6 has a conical top surface 6*a* having an inclination angle $\beta 1$ with respect to the horizontal plane. The angle $\alpha 1$ is larger than $\beta 1$.

The upper casing 2 comprises separate upper and lower rings 2*a* and 2*b*. A plurality of louvers 8 are arranged around a classifying chamber 5 at angular intervals.

The louvers 8 are pivotable about vertical axes and define passages therebetween, though neither of these features is shown. Secondary air is introduced into the classifying chamber 5 through these passages in a flow whirling in the same direction as the whirling direction of the powder in the classifying chamber 5.

The outer edge of the conical bottom surface 4*a* of the conical cover 4 forms a circle having a diameter equal to the diameter of the inner cylindrical surface of the upper casing 2, and is at substantially the same level as the top edges of the louvers 8.

A powder supply device 10 is provided around the louvers 8 to introduce a mixture of powder and compressed air into the classifying chamber 5 through the gaps between the louvers 8. The powder supply device 10 comprises injection nozzles 11 having their tips inserted in the gaps between the louvers 8 for blowing the powder-air mixture into the outer circumferential area of the classifying chamber 5.

A fine powder discharge tube 12 extends through the lower casing 3 and is connected to the central portion of the classifying plate 6.

In operation, a fluid mixture of powder and compressed air is introduced into the classifying chamber 5 through the injection nozzles 11, and a suction force is created in the fine powder discharge tube 12.

The powder-air mixture supplied into the classifying chamber 5 whirls therein. At the same time, secondary air is introduced into the classifying chamber 5 through the passages between the louvers 8 to accelerate the powder whirling in the classifying chamber 5. As a result the powder is centrifugally separated into fine and coarse particles.

Fine particles move toward the center of the classifying chamber 5 and are sucked and discharged through the fine powder discharge tube 12, while coarse particles move toward the outer circumference of the classifying chamber 5 and are discharged into the lower casing 3 through the coarse powder discharge port 7.

If the inner wall of the classifying chamber 5 had a cylindrical portion, powder would whirl in the outer circumferential portion of the classifying chamber 5 in contact with the cylindrical portion when it collides against the secondary air introduced through the gaps between the louvers 8. Powder is thus likely to adhere to the cylindrical surface and deposit.

According to the invention, the outer edge of the conical bottom 4*a* of the cover 4 forms a circle having a diameter substantially equal to the diameter of the inner cylindrical wall of the upper casing 2, and is at substantially the same level as the top edges of the louvers 8, so that the classifying chamber has no cylindrical portion. Powder whirling in the classifying chamber 5 at its outer circumferential portion is effectively dispersed by collision with the secondary air introduced into the classifying chamber 5 through the gaps between the louvers 8, and whirls carried by the flow of the secondary air. Thus, powder is classified effectively and stably without adhering to the inner wall of the classifying chamber 5, so that classified powder can be recovered efficiently.

Classification point was measured in classification of calcium carbonate with the classifier shown in FIG. 1. The results are shown in Table 2.

The test was conducted by supplying calcium carbonate at the feed rate of 5 kg/hr into the powder supply device 10 together with air compressed to 2 kg/cm$^2$ with the gaps between the louvers 8 set to 3 mm and a suction force of −0.3 kg/cm$^2$ created in the fine powder discharge tube 12.

Table 3 shows the dimensions of various parts of the classifier used in the test.

Figure 6:
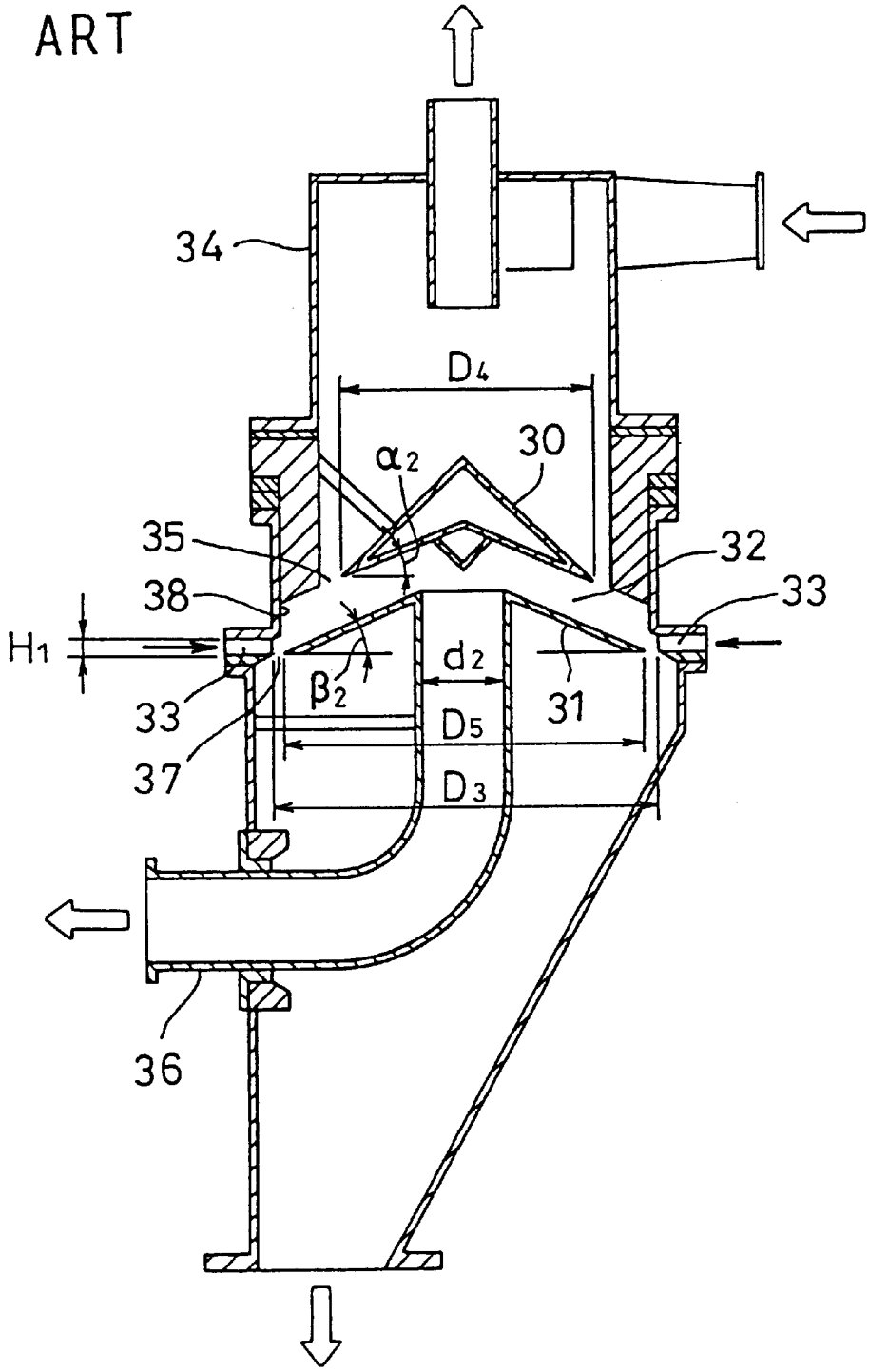
FIG. 6 PRIOR ART
FIG. 6 is a vertical sectional front view of a conventional classifier.

For comparison, the classification point was measured under the same conditions as above when calcium carbonate was classified in the conventional classifier of FIG. 6. The results are shown in Table 2. Table 3 shows dimensional data of this classifier.

TABLE 2

| | Present invention | Comperative example |
|---|---|---|
| Classification point (μm) | 3.01 | 4.44 |
| Max particle diameter (μm) | 5.50 | 7.78 |

TABLE 3

| Symbol | $D_1$ | $D_2$ | $d_3$ | $H_1$ | $\alpha_1$ | $\beta$ |
|---|---|---|---|---|---|---|
| Size(mm) | 280 | 270 | 60 | 20 | 60 | 24 |

D1 = inner diameter of the classifying chamber 5
D2 = outer diameter of the classifying plate 6
d1 = inner diameter of the fine powder discharge tube 7
H1 = height of the louvers 8
α1 = inclination angle of the conical bottom of the classifying cover 4
β1 = inclination angle of this conical top of the classifying plate 6

As will be apparent from Table 2, with the classifier of the first embodiment of the present invention the classification point can be reduced.

Three kinds of classifiers of the above type having covers 4 with conical bottom surfaces 4*a* inclined at angles α1 of 24°, 45° and 60° were prepared and used, and glass powder was classified in these classifiers and the classification point was measured. The results of measurement are shown in Table 4.

TABLE 4

| Inclination angle (degree) | Classification point (μm) | Max particle diameter (μm) |
|---|---|---|
| 24 | 3.39 | 11.00 |
| 45 | 1.82 | 6.54 |
| 60 | 0.84 | 5.50 |

Test conditions were: glass powder feed rate: 5 kg/hr, supply pressure: 2 kg/cm$^2$ suction force in the fine powder discharge tube 12: −0.3 kg /cm$^2$.

From the results of Table 4, it appears that the greater the inclination angle α1 of the conical bottom surface 4*a* of the cover 4, the smaller the classification point. But since centrifugal force always acts horizontally on the powder particles, the contact pressure of the particles against the conical bottom surface 4*a* of the classifying cover 4 tends to increase with an increase in the angle α1. Increased contact pressure promotes adhesion of powder to the classifying cover and wear of the classifying cover. Thus, the inclination angle α1 is preferably limited to 75° or less.

After powder classification, it is usually necessary to clean the classifying chamber. The classifier of the present invention is easy to clean because the cover 4 closing the opening of the upper casing is detachable. That is, the classifying chamber 5 is easily accessible from outside through this opening for cleaning or maintenance by removing the cover 4.

Figure 2:
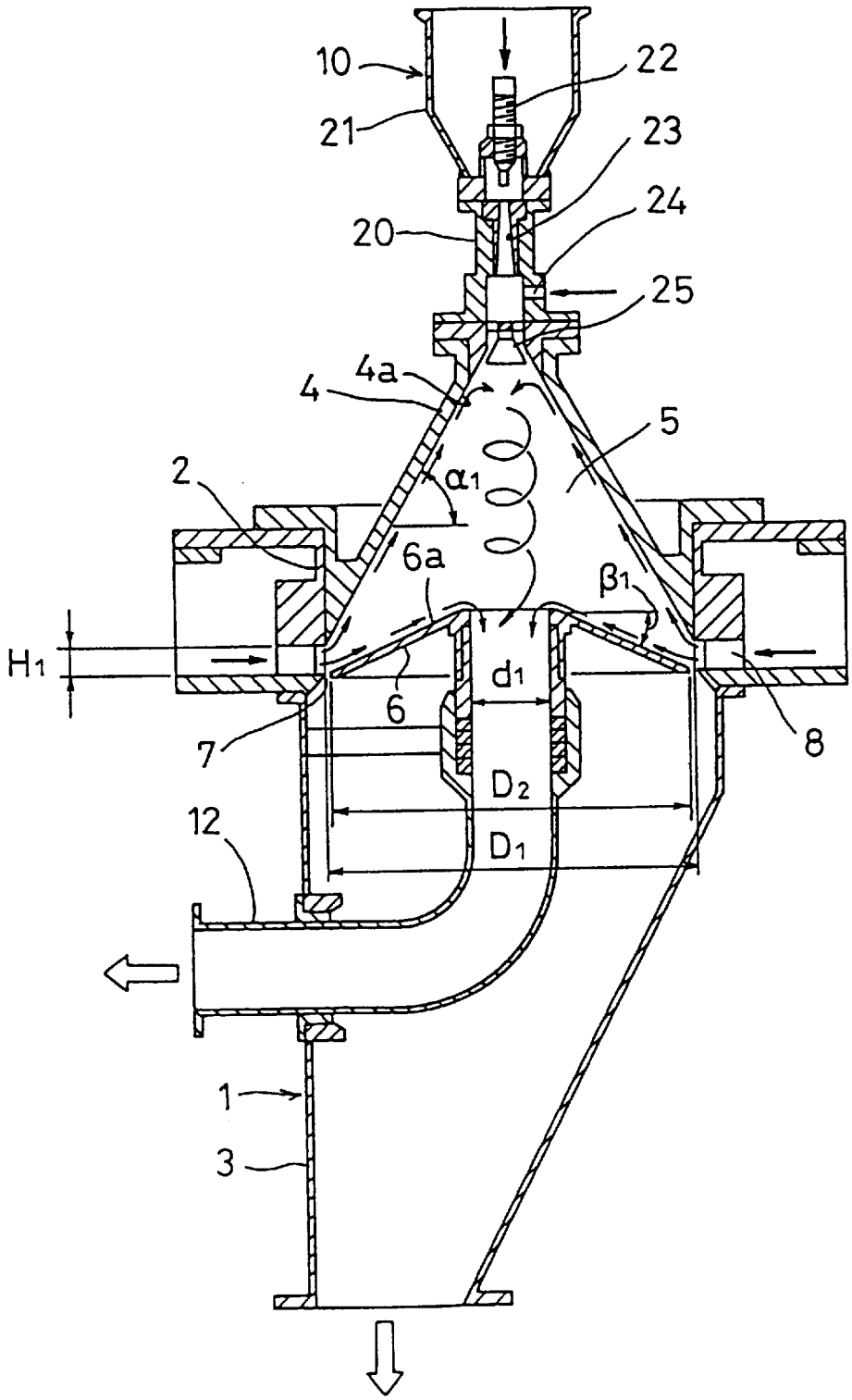
FIG. 2 is a vertical sectional front view of a second embodiment.
Figure 3A:
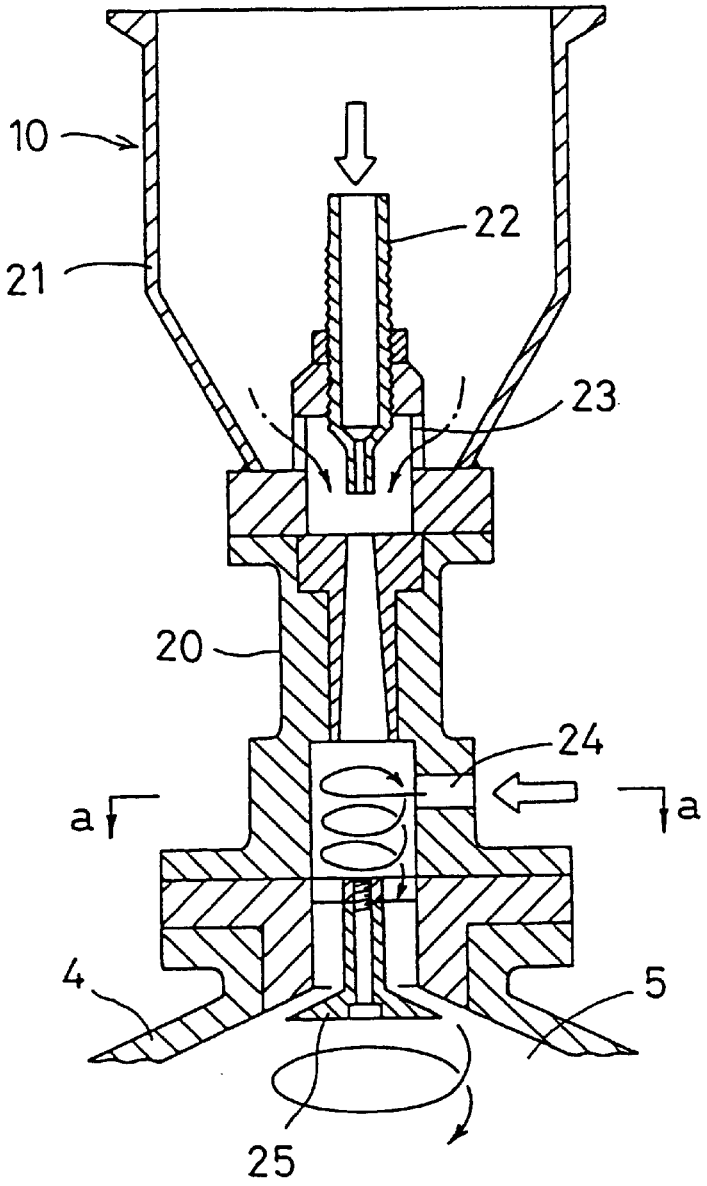
FIG. 3A is a vertical sectional front view of the powder supply device of the second embodiment.
Figure 3B:
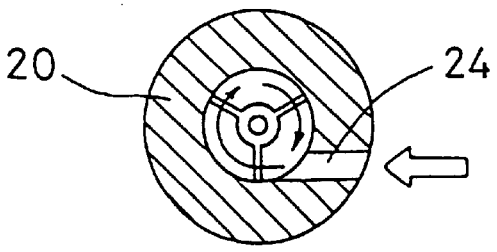
FIG. 3B is a sectional view taken along line a—a of FIG. 3B.

FIG. 2 and FIGS. 3A and 3B show other embodiments of this invention. These classifiers differ from the classifier of FIG. 1 only in the structure and mounting position of the supply device 10 for supplying a powder-air mixture into the classifying chamber 5.

The powder supply device 10 shown in FIG. 2 and FIGS. 3A and 3B is mounted on top of the conical cover 4. The powder supply device 10 comprises a powder supply tube 20 connected to the top center of the cover 4, a hopper 21 connected to the top of the tube 20, and an air injection nozzle 22 provided in the hopper 21 for blowing compressed air into the powder supply tube 20 to suck powder in the hopper 21 into the tube 20 through a hole 23.

Injection hole 24 through which compressed air is blown into the outer circumferential portion of the tube 20 to whirl the powder-air mixture flowing downwardly in the tube 20. The whirling mixture is supplied along the outer surface of a cone 25 provided at the bottom opening of the powder supply tube 20 into the classifying chamber 5.

Using a classifier of the type shown in FIG. 2 of which various parts have the dimensions shown in Table 3, tangential flow speeds at various radial positions in the classifying chamber 5 were measured when compressed air at 2 kg/cm$^2$ was supplied into the air injection nozzle 22 and the air injection hole 24 with a suction force of −0.3 kg/cm$^2$ was applied in the fine powder discharge tube 12, while also changing the gaps between the louvers 8. The results are shown in FIG. 4.

Figure 4:
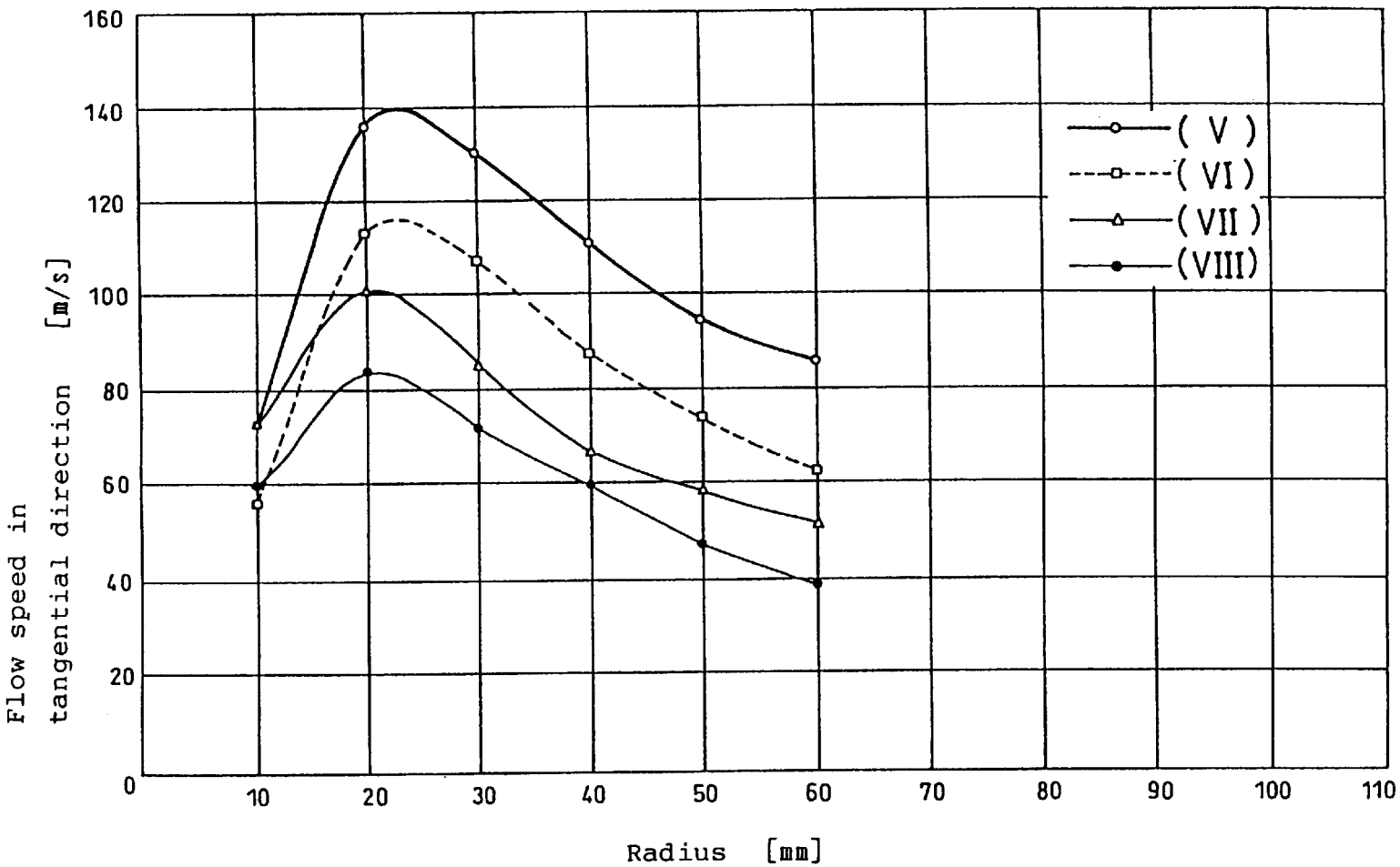
FIG. 4 is a graph showing the flow speeds in a tangential direction at radial positions in the classifying chamber of the classifier of FIG. 2.

In FIG. 4, the whirling speed curve V represents the results when the louvers were spaced by 1 mm from each other. Curves VI, VII and VIII represent the results when the distances between the louvers were 3, 5 and 7 mm, respectively.

Figure 7:
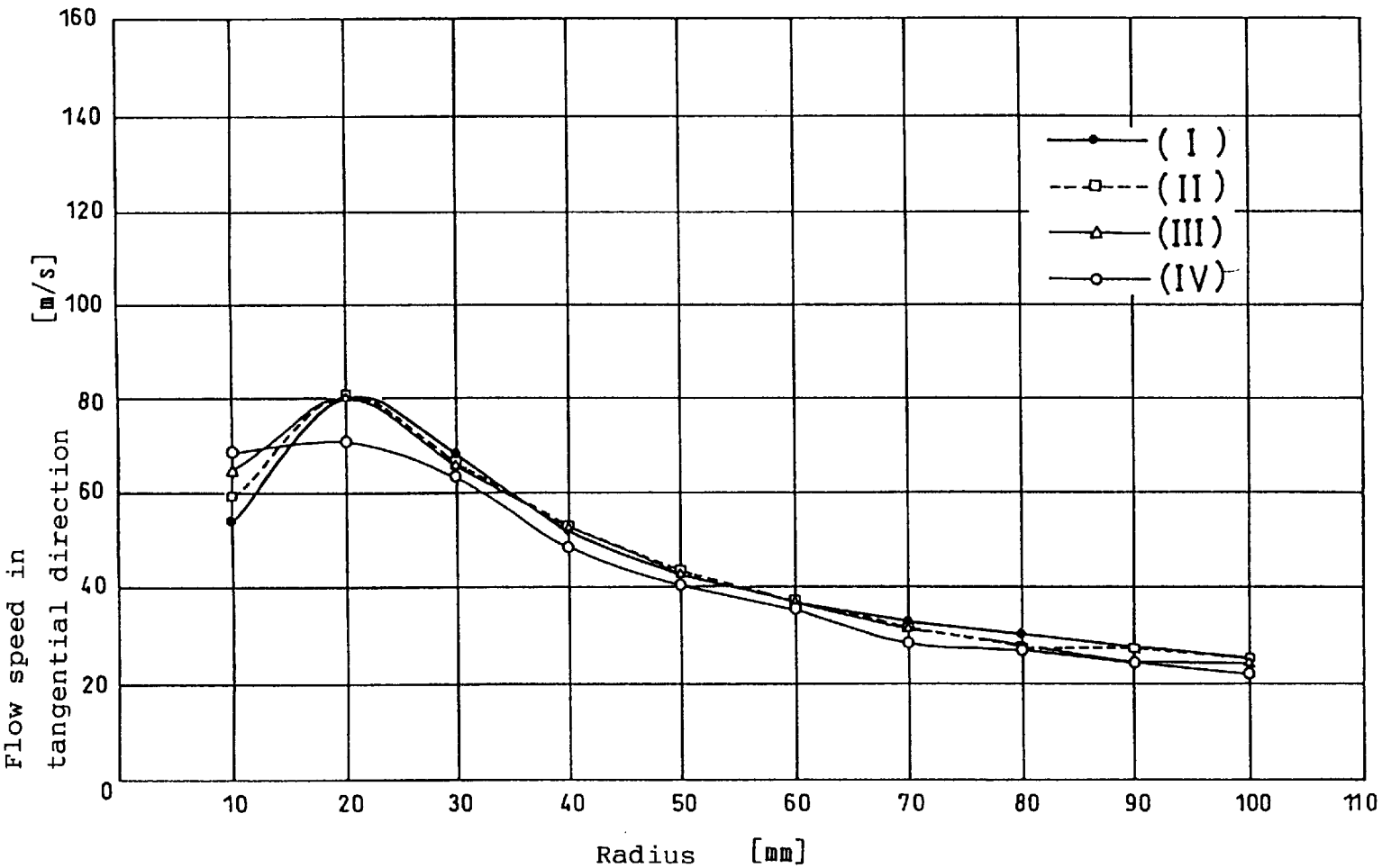
PRIOR ART FIG. 7
FIG. 7 is a graph showing the measurement results of tangential flow speeds at radial positions in the classifying chamber of the classifier of FIG. 6.

If this graph is compared with the graph of FIG. 7, it will be apparent that by inclining the conical bottom 4*a* of the classifying cover 4 at a greater angle than the conical top surface 6*a* of the classifying plate 6, it is possible to increase the whirling speed in the maximum whirling speed area.

Thus, by supplying a powder-air mixture into the maximum whirling speed area, it is possible to impart extremely large dispersing and whirling forces to the powder in the mixture.

This prevents coagulation and adhesion of powder in the classifying chamber 5, and imparts a large centrifugal force to the individual powder particles, so that it is possible to prevent coarse particles from mixing into the fine particles recovered from the fine powder discharge tube 12. This makes it possible to obtain fine powder having a narrow particle diameter distribution with the maximum particle diameter close to the peak particle diameter of the fine powder particle diameter distribution. Because powder can be swirled at high speed in the classifying chamber 5, the classification point can be reduced.

It is also possible to classify powder in a stable state and reduce the classification point.

Calcium carbonate was classified in the classifiers of FIGS. 2 and 3 to measure the classification point.

Dimensional data of the classifiers are shown in Table 3.

The test was conducted by supplying air compressed to 2 $kg/cm^2$ to the air injection nozzle 22 while creating a suction force of −0.3 $kg/cm^2$ in the fine powder discharge tube 12.

From Table 2 and the results of this test it is apparent that by supplying a powder-air mixture into the classifying chamber 5 from its top center with the inclination angle $\alpha$of the conical bottom surface of classifying cover set larger than the inclination angle $\beta$of the conical top surface 6*a* of the classifying plate 6, it is possible to further reduce the classification point.

Instead of calcium carbonate, a ceramic comprising tungsten dioxide (material 1), and a ceramic comprising barium titanate (material 2) were supplied into the classifier shown in FIGS. 2 and 3 to measure the classification point. For material 1, the classification point was 1.23 $\mu$and the maximum particle diameter of fine powder was 1.94 $\mu$m For material 2, the classification point was 0.7 $\mu$m and the maximum particle diameter of fine powder was 1.94 m.

Figure 5A:
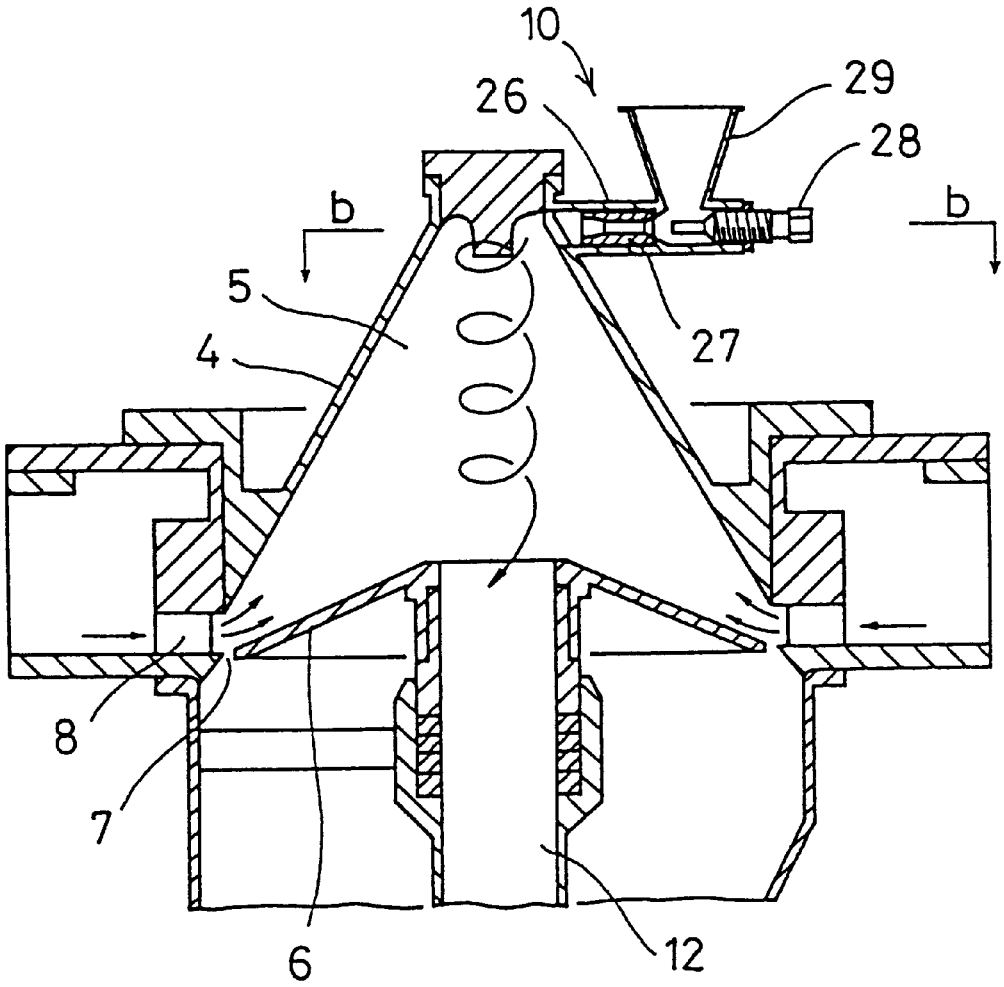
FIG. 5A is a vertical sectional view of a third embodiment.
Figure 5B:
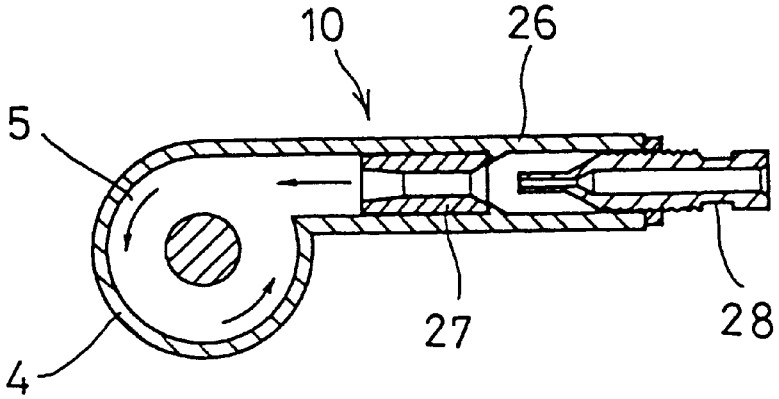
FIG. 5B is a sectional view taken along line b—b of FIG. 5A.

FIGS. 5A, 5B show a different embodiment of powder supply device 10. It comprises a powder supply tube 26 tangentially mounted at the top outer edge of the cover 4, a diffuser 27 mounted in the powder supply tube 26, an injection nozzle 28 inserted in the tube 26 so that its tip faces the diffuser 27 for blowing compressed air into the diffuser 27, and a hopper 29 having a bottom outlet disposed between the injection nozzle 28 and the diffuser 27. By blowing compressed air through the injection nozzle 28 into the diffuser 27, powder in the hopper 29 is sucked into the powder supply tube 26 to form a mixture of powder and compressed air, which is then blown through the tip of the powder supply tube 26 into the classifying chamber 5 along its outer top edge portion.

In this arrangement, too, it is possible to supply a mixture of powder and compressed air into a high-speed whirling area of the classifying chamber 5 and thus to impart on extremely large dispersing force and whirling force to the powder.

According to this invention, since the conical bottom surface of the classifying cover is inclined at a greater angle than the conical top surface of the classifying plate, it is possible to reduce the classification point and reduce the maximum particle diameter of the classified fine powder.

According to this invention, the cover closing the top opening of the casing is provided so that the outer edge of its conical bottom will be at substantially the same level as the top edges of the louvers 8. Thus the inner wall of the classifying chamber has no cylindrical portion. Thus, powder whirling in the classifying chamber 5 at its outer circumferential area is effectively dispersed by colliding against secondary air introduced into the classifying chamber through the gaps between the louvers and is carried by whirls with the flow of the secondary air. Thus, powder is classified effectively and stably without adhering to the inner wall of the classifying chamber, so that classified powder can be recovered efficiently.

Further, according to this invention, since powder is supplied to the central part of the classifying chamber from over the classifying cover, it is possible to obtain fine powder with the maximum particle diameter close to the peak particle diameter of the fine powder particle diameter distribution.

What is claimed is:

1. A classifier comprising:

a casing;

a conical cover provided over said casing and having a conical bottom surface;

a classifying plate provided under said conical cover and having a conical top surface, said classifying plate and said conical cover being arranged so as to define a classifying chamber between said conical bottom surface of said conical cover and said conical top surface of said classifying plate;

a plurality of louvers arranged around said classifying chamber, wherein passages are defined between said louvers;

a fine powder discharge tube connected to a central portion of said classifying chamber; and a coarse powder discharge port defined around an outer edge of said classifying plate;

wherein said conical cover, said classifying plate, said louvers, said fine powder discharge tube, and said coarse powder discharge port are arranged such that powder to be supplied into and whirling in said classifying chamber is to be accelerated by secondary air to be introduced into said classifying chamber through said passages so as to discharge fine powder through said fine powder discharge tube and so as to discharge coarse powder through said coarse powder discharge port; and wherein said conical bottom surface of said conical cover has a larger inclination angle than said conical top surface of said classifying plate with respect to a horizontal plane of said classifying chamber.

2. The classifier as claimed in claim 1, wherein said conical bottom surface of said cover has a circular outer edge having a diameter substantially equal to an inner diameter of said casing, and said circular outer edge is disposed at substantially the same level as a top edge of each of said louvers.

3. The classifier as claimed in claim 2, further comprising a powder supply device provided above said classifying cover for supplying a fluid mixture of powder and compressed air in a whirling flow into the central portion of said classifying chamber.

4. The classifier as claimed in claim 1, further comprising a powder supply device provided above said classifying cover for supplying a fluid mixture of powder and compressed air in a whirling flow into the central portion of said classifying chamber.

5. The classifier as claimed in claim 4, wherein said fluid mixture is supplied to a high-speed whirling area of said classifying chamber whereat said mixture whirls at a high speed, said high-speed whirling area being located above the inlet of said fine powder discharge tube.

6. The classifier as claimed in claim 5, wherein said powder supply device comprises:

a powder supply tube having a bottom end connected to a center portion of said conical cover;

a compressed air injection nozzle connected to a top of said powder supply tube; and a hopper having a bottom outlet communicating with a tip of said injection nozzle, said powder supply tube having an air injection hole for blowing compressed air toward an outer peripheral area in said powder supply tube.

7. The classifier as claimed in claim 5, wherein said powder supply device comprises:

a powder supply tube tangentially extending from an outer periphery of an upper part of said classifying cover;

a compressed air injection nozzle provided at one end of said powder supply tube; and a hopper connected to said injection nozzle.

8. The classifier as claimed in claim 4, wherein said powder supply device comprises:

a powder supply tube having a bottom end connected to a center portion of said conical cover;

a compressed air injection nozzle connected to a top of said powder supply tube; and a hopper having a bottom outlet communicating with a tip of said injection nozzle, said powder supply tube having an air injection hole for blowing compressed air toward an outer peripheral area in said powder supply tube.

9. The classifier as claimed in claim 4, wherein said powder supply device comprises:

a powder supply tube tangentially extending from an outer periphery of an upper part of said classifying cover;

a compressed air injection nozzle provided at one end of said powder supply tube; and a hopper connected to said injection nozzle.

10. The classifier as claimed in claim 1, wherein said conical bottom surface of said conical cover has an angle of inclination in a range of 45° to 75°.

* * * * *